United States Patent [19]

Annovi

[11] Patent Number: 4,542,599

[45] Date of Patent: Sep. 24, 1985

[54] SKI BOOT WITH A NORMALIZED SOLE

[75] Inventor: Giuseppe Annovi, Montebelluna, Italy

[73] Assignee: Dolomite, S.p.A., Montebelluna, Italy

[21] Appl. No.: 625,965

[22] Filed: Apr. 13, 1984

Related U.S. Application Data

[63] Continuation of Ser. No. 306,386, Sep. 28, 1981, abandoned.

[30] Foreign Application Priority Data

Nov. 12, 1980 [IT] Italy ..... 84157 A/80

[51] Int. Cl.[4] ..... A43B 5/04; A43B 13/14

[52] U.S. Cl. ..... 36/117; 36/15; 36/132

[58] Field of Search ..... 36/117–121, 36/132, 136, 15, 100, 101

[56] References Cited

U.S. PATENT DOCUMENTS

| | | | |
|---|---|---|---|
| 3,263,348 | 8/1966 | Cohen et al. | 36/117 |
| 3,396,479 | 8/1968 | Primak | 36/117 X |
| 4,261,114 | 4/1981 | Viletto | 36/132 X |
| 4,351,120 | 9/1982 | Dalebout | 36/117 |

FOREIGN PATENT DOCUMENTS

| | | | |
|---|---|---|---|
| 3004096 | 8/1980 | Fed. Rep. of Germany | 36/132 |
| 3004668 | 8/1981 | Fed. Rep. of Germany | 36/100 |
| 1007131 | 2/1952 | France | 36/15 |
| 2278281 | 2/1976 | France | 36/132 |

*Primary Examiner*—James Kee Chi

*Attorney, Agent, or Firm*—Kimmel, Crowell & Weaver

[57] ABSTRACT

A ski boot possesses a foot portion and sole constructed for comfortable and easy walking. A separately formed normalized sole attachment for the ski boot interlocks securely therewith and renders the boot compatible to substantially any ski binding.

8 Claims, 3 Drawing Figures

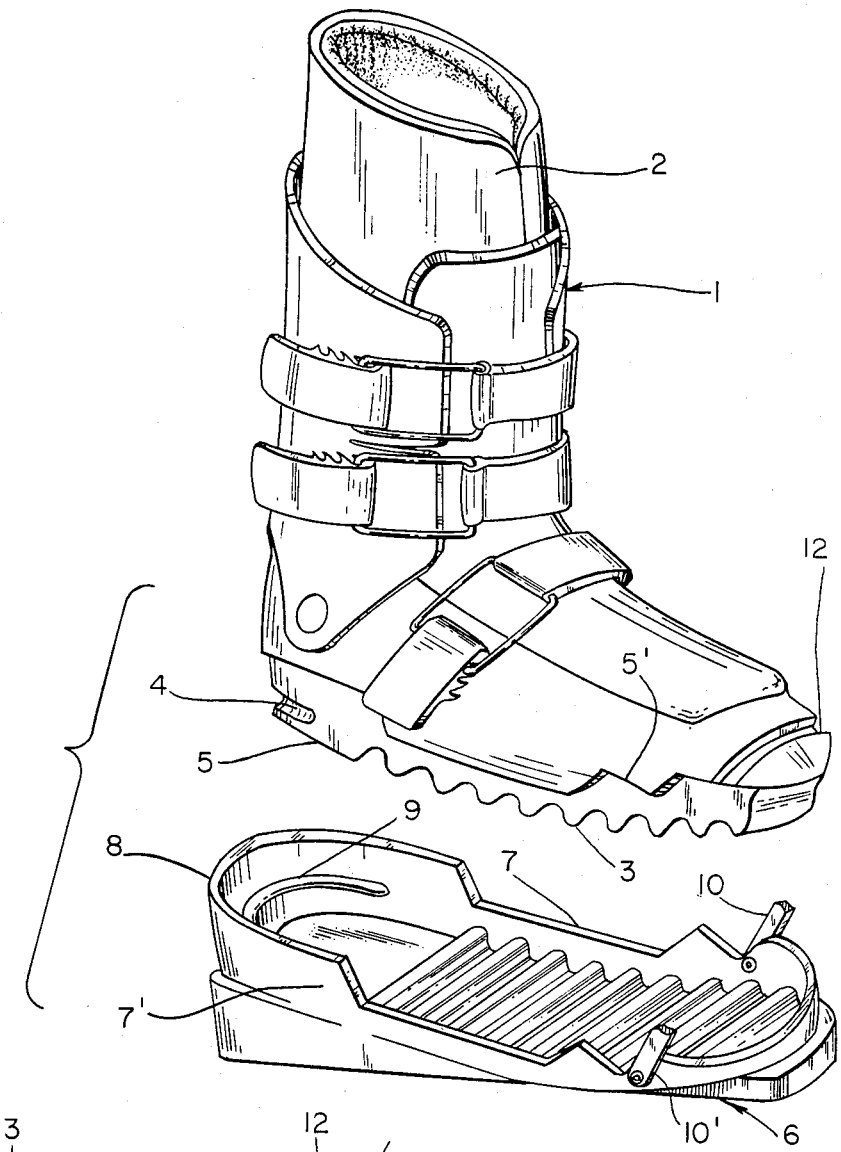
FIG. 1
FIG. 2
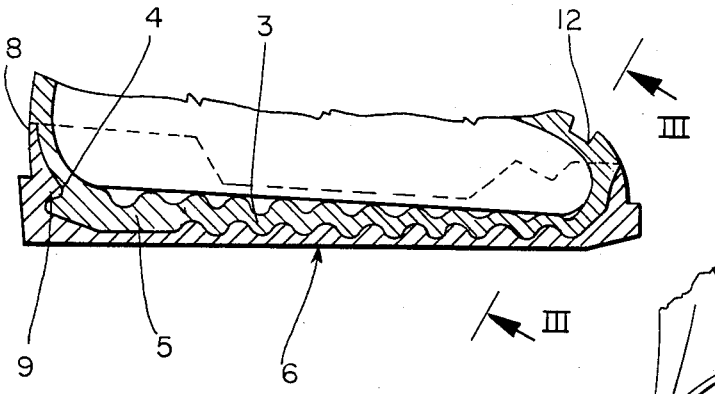
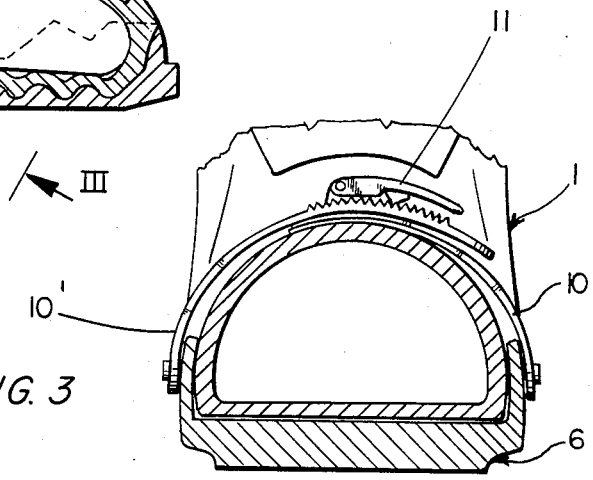
FIG. 3

SKI BOOT WITH A NORMALIZED SOLE

This is a continuation, of application Ser. No. 306,386, filed Sept. 28, 1981 now abandoned.

BACKGROUND OF THE INVENTION

Ski boots having soles insertable in ski bindings or fastenings are well known in the prior art. The soles of such boots are normalized or conformable in relation to the ski binding. Such soles require certain rigid projections and dimensions particularly in the areas of the toes and heels. Normalized ski boot soles present an obstacle to regular walking without skis but are absolutely essential for adapting the boots to ski bindings. In particular, a normalized sole:

- is longer than a non-ski boot sole because of the need for projecting portions at the front and back, and this increased length prevents correct movements in walking, causing some instability. The projections also create increased weight which further inhibits regular walking;
- is flat without pronounced recesses which, in non-ski boots, are necessary to prevent sliding;
- at its bottom is provided with an anti-friction area which rests on a sliding plate joined to the front fastening of the ski. In regular walking, the anti-friction area can be damaged and at the same time damaging the sliding plate;
- is formed of materials of substantial hardness which weight the foot and make walking uncomfortable. Also they tend to form a layer of snow under the sole of the boot obstructing correct contact of the boot with the binding.

In short, the normalization of the sole of the ski boot is very obstructive to normal walking but is however quite necessary for keeping the bottom properly joined to a ski.

In accordance with this invention, a structure is provided which completely satisfies the opposing requirements for easy regular walking without skis while having the boot readily applicable to substantially any ski fastening by means of a normalized sole. The normalized sole, according to the invention, is in the form of a separately formed attachment rigidly and removably connected to the foot portion of the ski boot which possesses a regular walking sole.

BRIEF DESCRIPTION OF THE DRAWINGS

FIG. 1 is an exploded perspective view of a ski boot according to the invention.

FIG. 2 is a fragmentary longitudinal vertical section through the assembled boot.

FIG. 3 is an enlarged cross section taken on line III—III of FIG. 2.

DETAILED DESCRIPTION

Referring to the drawings in detail wherein like numerals designate like parts, a ski boot formed of injection molded plastics is illustrated having an external foot portion 1 and an inner stuffing 2 projecting above the leg portion of the external foot portion. The foot portion 1 includes a regular walking sole 3 without front and back projections and includes transverse grooves as shown to form a good anti-slip tread suited to walking on snow or ice.

The foot portion 1 is also provided at its rear with a locking groove 4 horizontally extending along substantially the entire heel 5. The groove is preferably tapered in cross section.

The foot portion 1 above its walking sole 3 has a continuous peripheral profiled projecting step or ledge 5', adapted for complementary engagement with a profiled top edge 7 of an upstanding marginal wall 7' rising from the normalized sole 6, now to be described.

The ski boot also comprises a separately formed detachable sole 6 which is normalized to fit substantially any ski fastener. The sole 6 is formed of quite rigid material. It has a marginal edge 7 projecting upwardly to receive inwardly thereof the sole of foot portion 1 and to lock the sole of the foot portion against lateral displacement on the normalized sole 6. Similarly, a rear upstanding edge portion 8 of the normalized sole has an internal rib 9 which interfits and locks with the groove 4 of foot portion 1. The arrangement prevents both vertical and rear longitudinal displacement of the foot portion 1 relative to the normalized sole 6.

The front of the normalized sole 6 is provided with two straps 10, 10' interengageable through a lever 11 and which engage within a transverse groove 12 at the front of foot portion 1. Moreover, the internal upper surface of the sole 6 is ribbed for exact complementary engagement with the anti-slip sole 3 and also the internal portion of the heel of sole 6 is truncated pyramid-shaped and complementary to the heel 5 of foot portion 1 which is of like shape for precise interfitting and centering.

The boot according to the invention is used as follows:

In the absence of the normalized sole attachment 6, the boot can be used for regular walking and is quite comfortable and secure and relatively lightweight. For skiing, the foot portion 1 is applied to the normalized sole 6 by first engaging the back groove 4 with the rib 9 and subsequently locking down the front of the foot portion by means of the straps 10, 10'. After the boot foot portion 1 is firmly secured to the sole attachment 6, it is transformed into a ski boot having a properly normalized sole allowing clamping by any ski binding in the traditional way. When the skier has finished skiing and wishes to take off the skis, he can release the bindings and then release the lever 11 and slip the foot portion 1 from the sole 6. It is also possible to release the lever 11 before releasing the ski bindings, and so release the boot foot portion from the sole 6 which remains fixed to the skis.

From what has been said it is clearly apparent that the ski boot according to the invention possesses the following advantages:

(1) It provides a higher grade of security since the anti-friction area of the normalized sole 6 is never placed on the ground and subjected to damage.

(2) It enables application of the boot to any ski binding or fastener.

(3) It enables comfortable walking since the foot portion 1 is separable from the normalized sole 6 and the sole 3 of the foot portion does not possess the awkward front and back projections of the normalized sole, is lighter and softer, has anti-slip grooves, and is formed of less rigid materials.

(4) It avoids the formation of a layer of snow under the sole.

(5) In case of damage, it allows replacing only the sole 6 with obvious savings.

(6) It allows making the foot portion 1 from plastics materials of any grade without being subject to regulations which are more stringent for the normalized sole which connects with the skis.

The invention has been described in a preferred form, but it is understood that modifications are possible without departing from the scope of the subjoined claims. For example, other types of locking means may be used between the foot portion 1 and normalized sole 6 including other mechanical systems, electromagnets, adhesives, hydraulics and the like. Moreover, the described embodiment, while relating to a ski boot, does not preclude extending the invention to other types of footwear where a normalized sole is required.

I claim:

1. A ski boot having a sole and foot portion constructed for comfortable walking when a wearer is not engaged in skiing, a normalized sole attachment separate from the ski boot and being of a size, shape and hardness to be engageable with substantially any ski binding but rendering normal walking during non-skiing activity difficult and uncomfortable, rigid means peripherally around said upper above said sole portion, further rigid means peripherally around said sole attachment for complementary engagement with said first rigid means, and means on the ski boot and normalized sole attachment having interengagement for releasably securing the attachment to the ski boot.

2. A ski boot formed of injected plastics material comprising an upper having a sole portion constructed for comfortable walking when a wearer is not engaged in skiing, said upper having a rigid peripheral projecting step spaced above said sole portion, a normalized sole attachment separate from the upper and being of a size, shape and hardness to be engageable with substantially any ski binding but rendering normal walking during non-skiing activity difficult and uncomfortable, said normalized sole attachment having an upstanding marginal wall portion including a rigid upper edge complementary to said rigid peripheral projecting step for reciprocal engagement therewith, and means on the upper and normalized sole attachment having interengagement for releasably securing the normalized sole to the upper.

3. A ski boot as defined in claim 2, and the sole portion of the upper having a bottom anti-slip profile, and the top surface of the normalized sole attachment having an anti-slip profile complementary to the anti-slip profile of the sole portion of the upper.

4. A ski boot having a sole and foot portion constructed for comfortable walking when a wearer is not engaged in skiing, a normalized sole attachment separate from the ski boot and being of a size, shape and hardness to be engageable with substantially any ski binding but rendering normal walking during non-skiing activity difficult and uncomfortable, means on the ski boot and normalized sole attachment having interengagement for releasably securing the attachment to the ski boot, and said means comprising an attachment strap on the normalized sole attachment near its front, the foot position of the ski boot having a transverse groove across its top near the toe and thereof adapted to receive said strap releasably, rigid means peripherally around said upper above said sole portion, further rigid means peripherally around said sole attachment for complementary engagement with said first rigid means, and substantially rigid transverse interlocking elements on the normalized sole attachment and boot near the heel end thereof.

5. A ski boot as defined in claim 1, and said attachment including an upstanding marginal wall portion adapted to receive therein the sole and foot portion of the ski boot to lock the same relative to the normalized sole attachment.

6. A ski boot as defined in claim 1, wherein the sole of the ski boot includes a bottom anti-slip profile and the upper surface of the normalized sole attachment includes an anti-slip profile complementary to the anti-slip profile of the ski boot sole.

7. A ski boot as defined in claim 6, wherein said anti-slip profiles comprise a plurality of traverse grooves.

8. A ski boot as defined in claim 3, wherein said anti-slip profiles comprise a plurality of traverse grooves.

* * * * *